US008656543B2

(12) United States Patent
Porter et al.

(10) Patent No.: US 8,656,543 B2
(45) Date of Patent: Feb. 25, 2014

(54) BRIDGE SHORING SYSTEM

(75) Inventors: Paul Westley Porter, Jacksonville, FL (US); Bernard Sain, Jacksonville, FL (US)

(73) Assignee: Encon Technologies, LLC, Jacksonville, FL (US)

( * ) Notice: Subject to any disclaimer, the term of this patent is extended or adjusted under 35 U.S.C. 154(b) by 366 days.

(21) Appl. No.: 12/883,257

(22) Filed: Sep. 16, 2010

(65) Prior Publication Data

US 2012/0011665 A1 Jan. 19, 2012

Related U.S. Application Data

(60) Provisional application No. 61/462,049, filed on Jul. 13, 2010, provisional application No. 61/364,442, filed on Jul. 15, 2010, provisional application No. 61/371,916, filed on Aug. 9, 2010.

(51) Int. Cl.
*E01D 21/00* (2006.01)
*E01D 19/02* (2006.01)

(52) U.S. Cl.
USPC ..... 14/77.1; 14/77.3

(58) Field of Classification Search
USPC ..... 14/77.1, 75, 78, 77.3
See application file for complete search history.

(56) References Cited

U.S. PATENT DOCUMENTS 1,233,743 A * 7/1917 Arndt ..... 52/632
3,034,162 A * 5/1962 Smith ..... 14/72.5
3,209,508 A * 10/1965 Hunnebeck ..... 52/632
3,296,640 A 1/1967 Gunn
3,376,011 A 4/1968 Petchuk
4,045,936 A 9/1977 Sterner
4,102,096 A 7/1978 Cody
4,123,031 A * 10/1978 Hyre ..... 249/24
4,745,724 A * 5/1988 Reetz ..... 52/632
4,821,480 A * 4/1989 Silvey ..... 52/632
4,880,203 A 11/1989 Holcomb et al.
4,957,186 A * 9/1990 Reetz ..... 248/284.1
4,977,636 A * 12/1990 King ..... 14/73
5,072,911 A 12/1991 Logsdon
5,987,680 A * 11/1999 Sakaya ..... 14/73
6,038,823 A 3/2000 Gallimore et al.
6,663,322 B1 12/2003 Listle
7,363,671 B2 4/2008 Snead
7,571,577 B2 8/2009 Nanayakkara
2003/0217420 A1* 11/2003 Snead ..... 14/77.1
2004/0148717 A1* 8/2004 Kornatsky ..... 14/77.1
2005/0172427 A1* 8/2005 Sykes ..... 14/75
(Continued)

*Primary Examiner* — Thomas B Will
*Assistant Examiner* — Abigail A Risic
(74) *Attorney, Agent, or Firm* — Smith Gambrell & Russell LLP

(57) ABSTRACT

A replacement bent for shoring a bridge and a method for installing the replacement bent. The replacement bent comprises a metal I-beam sill, telescoping, adjustable posts, and a metal I-beam cap. In one embodiment, the adjustable posts are connected at one end by hinges to the sill beam and are connected at the other end by hinges to the cap beam. In a second embodiment, the adjustable posts are connected at right angles to the cap beam and the sill beam by means of support plates. The posts may be telescoped and thereby adjusted to the necessary distance between the sill beam and the cap beam. The replacement bent is supported on the stub piles from the substandard bent that has been removed.

2 Claims, 11 Drawing Sheets

(56) References Cited

U.S. PATENT DOCUMENTS

2005/0194000 A1 9/2005 Todack
2005/0262651 A1* 12/2005 Snead ..... 14/77.1
2007/0163058 A1 7/2007 Hornsi
2007/0251031 A1* 11/2007 Tokuno et al. ..... 14/75
2008/0072510 A1 3/2008 Wells et al.
2009/0282626 A1 11/2009 Powers

* cited by examiner

-PRIOR ART-

BRIDGE SHORING SYSTEM

CROSS REFERENCE TO RELATED PATENT APPLICATIONS

This patent application claims priority from U. S. Provisional Application No. 61/462,049 filed Jul. 13, 2010, U.S. Provisional Patent Application No. 61/364,442, filed Jul. 15, 2010, and U.S. Provisional Patent Application No. 61/371,916, filed Aug. 9, 2010, and which are hereby incorporated by reference.

BACKGROUND OF THE INVENTION

The shoring of bridges and trestles, including railroad bridges and trestles, is a necessary and vital activity that must be undertaken to ensure safe and continuous traffic during the construction or repair of the bridge, particularly where existing bridge bents are substandard. Conventionally, shoring a bridge included framing a new timber bent to replace or augment the existing substandard bent. Shoring a bridge with a new timber bent required driving new piles adjacent to the piles of the substandard bent and placing a new timber cap over the new piles. In addition, timber shims were necessarily installed between the new timber cap and the stringers of the bridge's superstructure to ensure a tight fit to carry the traffic loads. Such conventional shoring of a bridge was a costly undertaking because: a) the new timber piles were driven between the rails and under the existing bridge, requiring extensive work on the superstructure of the existing bridge, b) most of the material used for the new bent was timber, and once cut, the timber could not be used again except in cases where timber of the cut length or shorter were required. The new timber bent was also constructed of creosote treated timbers resulting in pollution of any waterway over which the bridge was constructed.

In addition, a skilled carpenter had to be on hand to ensure the dimensions and fit-up were correct. Also, new Federal Railway Administration (FRA) guidelines require that all temporary falsework, shoring, and brace frames (including new timber bents) have to be designed by a professional engineer. Consequently, the design costs, required to design a new timber frame, mount quickly.

SUMMARY OF THE INVENTION

The present invention provides a solution to the problems of shoring a bridge with a new timber bent. Particularly, the present invention provides an adjustable framing/shoring system made from steel that can be adjusted to different height requirements, is reusable, and is professionally designed to handle a wide range of shoring/bracing situations encountered in shoring a bridge.

The present invention comprises a replacement bent for shoring a bridge during repair and/or replacement. The replacement bent of the present invention includes an upper I-beam cap (H-pile) and lower I-beam sill with telescoping Hollow Structural Section (HSS) (square tube) posts mounted between the I-beam cap and the I-beam sill. The telescoping posts may have two or more sections with each section having a series of holes spaced in a longitudinal direction so that the posts can be set at the required height by use of pins placed in the holes between the two (or more) post sections to lock the height of the posts. The hole-spacing is fixed to allow fine adjustments of height of the posts and therefore the distance between the I-beam sill and the I-beam cap. By varying the lengths of the posts, the replacement bent can accommodate different height requirements for different bridges.

Should the posts, cap, or sill of the replacement bent be damaged, those components can be easily replaceable by simply unbolting the posts from the cap and sill.

Further objects, features and advantages will become apparent upon consideration of the following detailed description of the invention when taken in conjunction with the drawings and the appended claims.

DETAILED DESCRIPTION

Figure 1:
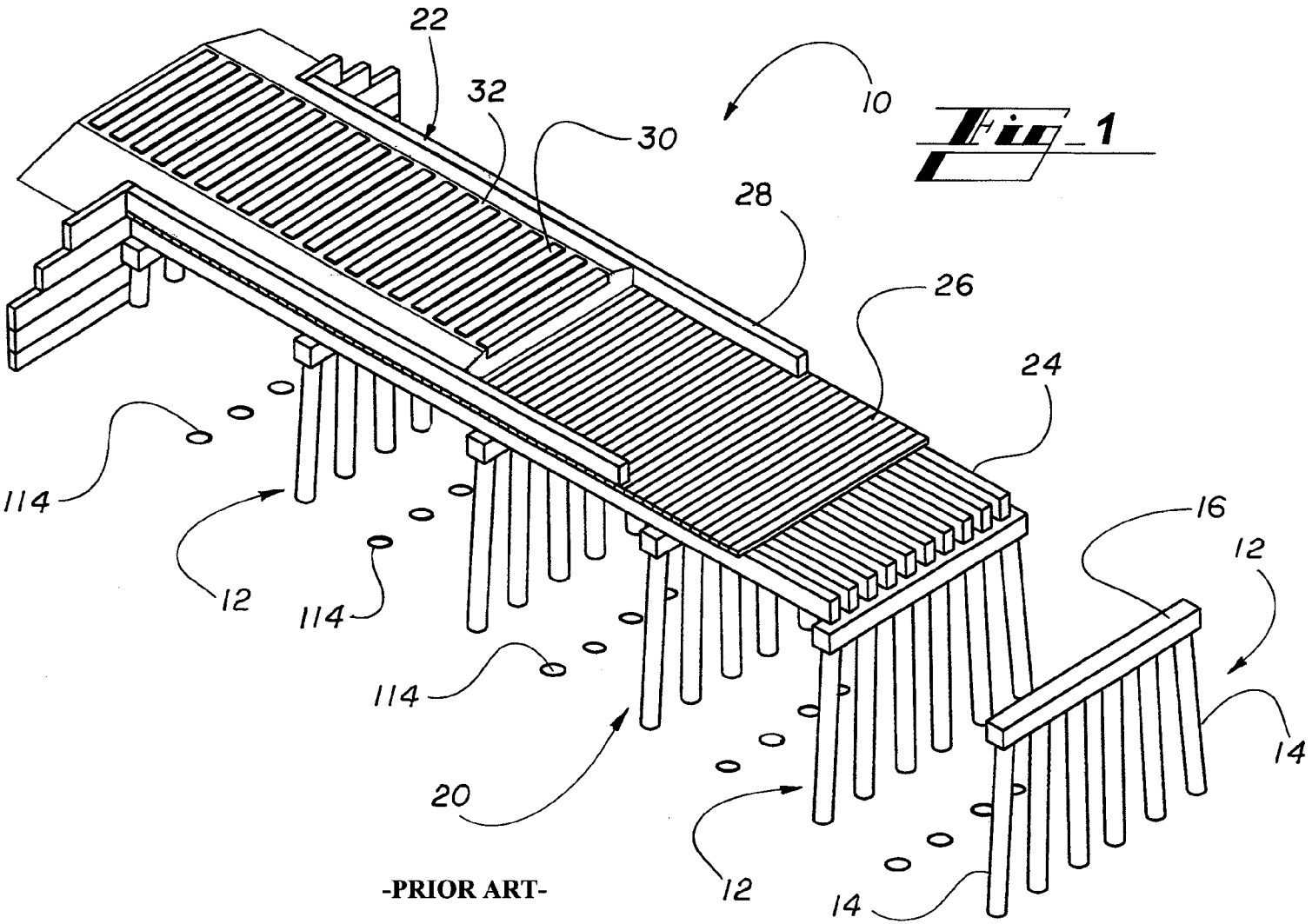
FIG. 1 is a perspective view of a conventional timber railroad bridge.

FIG. 1 illustrates the components of a conventional timber railroad bridge 10. The bridge 10 comprises a series of wooden bents 12 that span a waterway 20 or other topographical depression such as a gulley. Each bent 12 comprises several vertical timber piles 14 and a single timber cap 16. To construct the bent 12, several vertical piles 14 are driven into the ground. As shown in FIG. 1, six vertical piles 14 are used to construct bent 12, although those skilled in the art recognize that additional or fewer piles 14 may be used. Cap 16 is then placed across the top of the piles 14 and fastened to the piles 14 using suitable means such as spikes or nails.

After all the bents 12 have been constructed over the waterway 20, timber stringers 24 are placed horizontally on top of bents 12. Thereafter, the conventional timber bridge 10 is completed by placing a timber road deck 26, timber curbs 28, cross ties 30, ballast 32, and rails (not shown) over the stringers 24 to form a superstructure 22 for the bridge 10. FIG. 1 further shows a series of cut stub pilings 114 from an earlier bridge that has been replaced.

Figure 2:
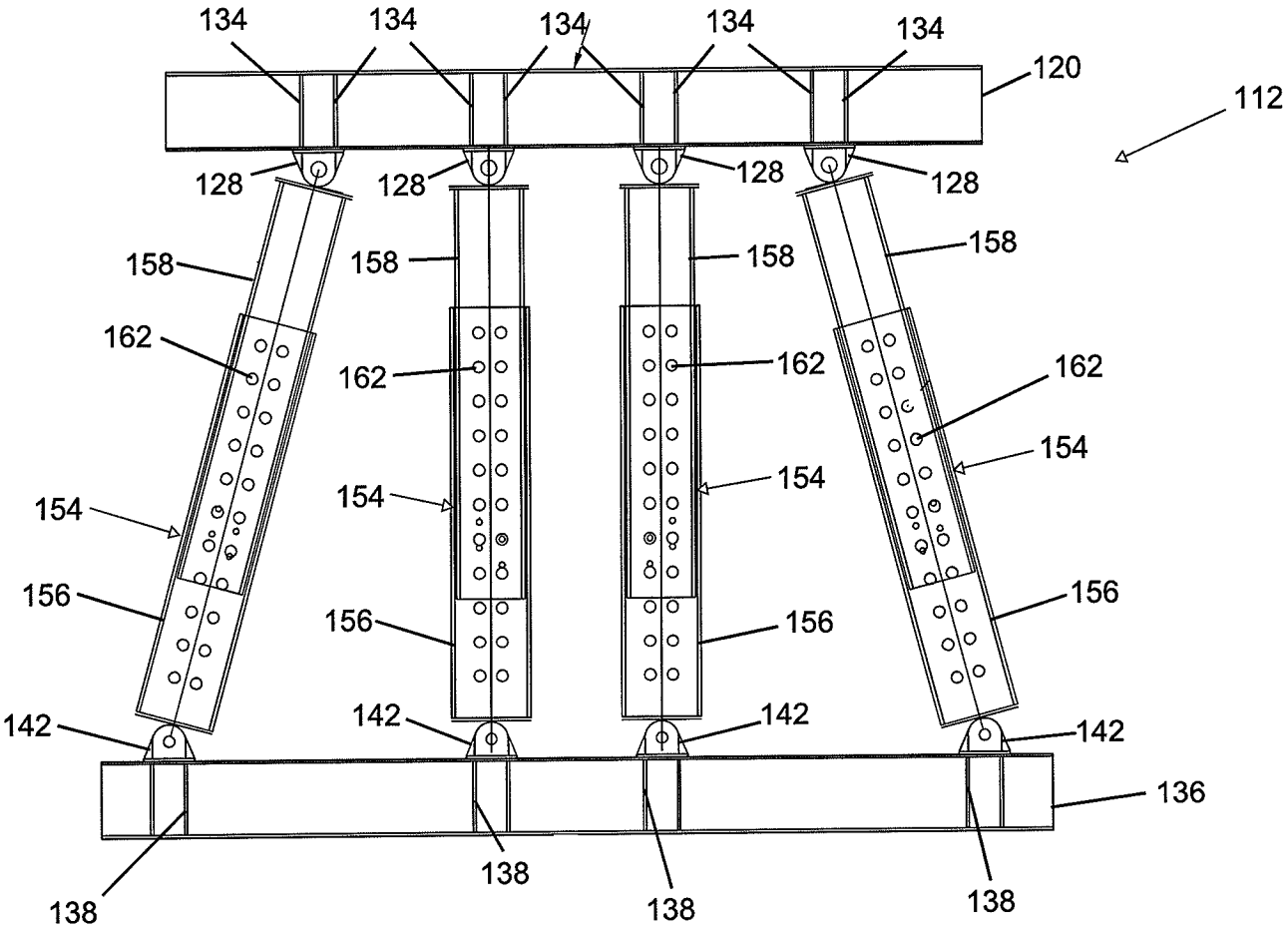
FIG. 2 is a front elevation view of a first embodiment of a replacement bent for shoring a bridge in accordance with the present invention.
Figure 3:
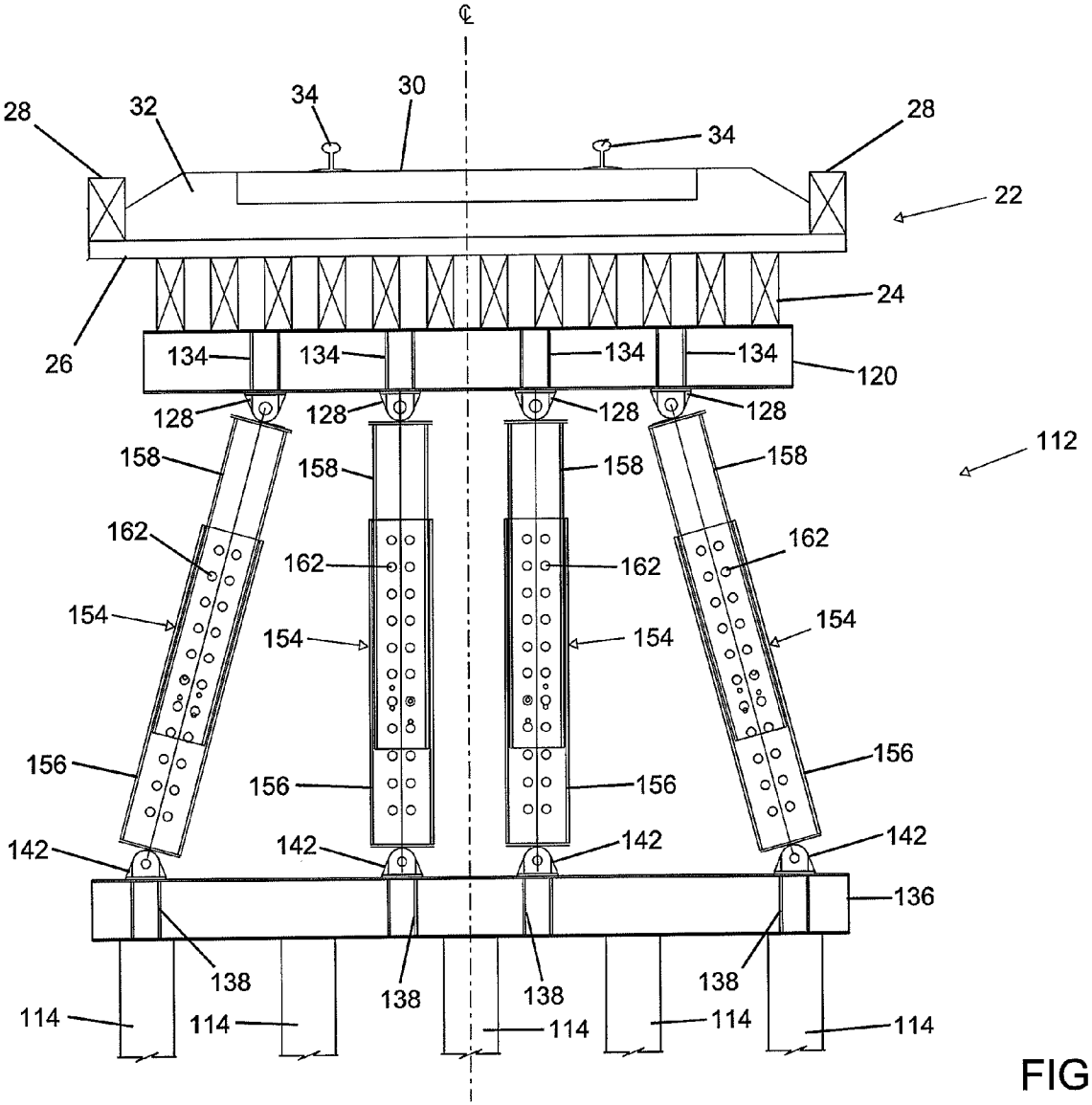
FIG. 3 is a front elevation view of the first embodiment of the replacement bent supporting the superstructure of a bridge for shoring the bridge in accordance with the present invention.

When one of the timber bents 12 shown in FIG. 1 has deteriorated to a point that the timber bent 12 is substandard and requires replacement in order to shore up the bridge 10, the substandard timber bent 12 is replaced by a replacement shoring bent 112 (FIGS. 2 and 3) constructed in accordance with a first embodiment of the present invention or by a replacement shoring bent 212 (FIG. 6) constructed in accordance with a second embodiment of the present invention. With reference to FIGS. 2 and 3, the first embodiment of the replacement bent 112 comprises a sill beam 136 comprising a metal I-beam, adjustable posts 154, and a cap beam 120 comprising a metal I-beam. The adjustable posts 154 are connected by means of hinges 142 to the metal sill beam 136 and are connected by means of hinges 128 to the metal cap beam 120. At least one of the adjustable posts 154 are connected, by means of the hinges 128, between the cap beam 120 and the sill beam 136 at an angle to the vertical to ensure that the cap beam 120 and the sill beam 136 are substantially parallel to each other. As illustrated in FIG. 2, the outside adjustable posts 154 are set at angles from the vertical to ensure that the cap beam 120 and the sill beam 136 are substantially parallel. In addition, by adjusting the length of the adjustable posts 154, the angle between the cap beam 120 and the sill beam 136 can be adjusted to compensate any deviation from parallel between a plane defined by the tops of the stub pilings 114 and a plane defined by the bottom of the stringers 24.

Figure 4:
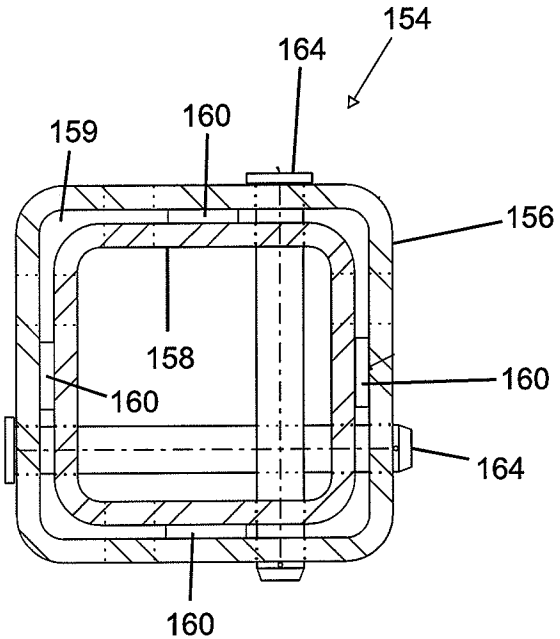
FIG. 4 is cross section view of one of the adjustable posts, having two sections, used in constructing the first embodiment of the replacement bent in accordance with the present invention.

In the first embodiment of the present invention shown in FIGS. 2-4, each of the adjustable posts 154 comprises a square internal tube 158 telescoped within a square external tube 156. While the adjustable posts 154 of the present invention are illustrated showing two sections 156 and 158, a greater number of sections may be employed to accommodate additional height. The internal tube 158 and external tube 156 both have a series of holes 162 spaced along their respective lengths. Locking pins 164 (FIG. 4) selectively engage the holes 162 in the internal tube 158 and external tube 156 to lock the internal tube 158 and the external tube 156 together at a predetermined length. By telescoping the internal tube 158 in and out of the external tube 156, the length of the post 154 can be varied to accommodate the height of the particular bridge 10 being shored.

The telescoping arrangement between the internal tube 158 and the external tube 156 of the posts 154 is shown in greater detail in FIG. 4. Because the square tubes that are used for the internal tube 158 and for the external tube 156 come in standard sizes, a gap 159 may exist between the external surface of the internal tube 158 and the internal surface of the external tube 156. In order to provide a snug fit between the internal tube 158 and the external tube 156 and to provide bearing surfaces on which the internal tube 158 and external tube 156 can slide with respect to each other, shims 160 are welded to either the external surface of the internal tube 158 or to the internal surface of the external tube 156. In one embodiment for the adjustable posts 154, the inside dimension of the external tube 156 is 8.75 inches, and the outer dimension of the internal tube 158 is 8.00 inches thereby leaving a gap 159 of 0.75 inch. In order to accommodate that gap, shims having a combined thickness of 0.50 inches are welded to the external surface of the internal tube 158 leaving a nominal gap of only 0.25 inch. While the adjustable posts 154 are illustrated as square in cross-section, a person of ordinary skill in the art will appreciate that the adjustable posts 154 may have other cross-sectional shapes including without limit round, oval, rectangular, triangular, hexagonal, etc.

Figure 5:
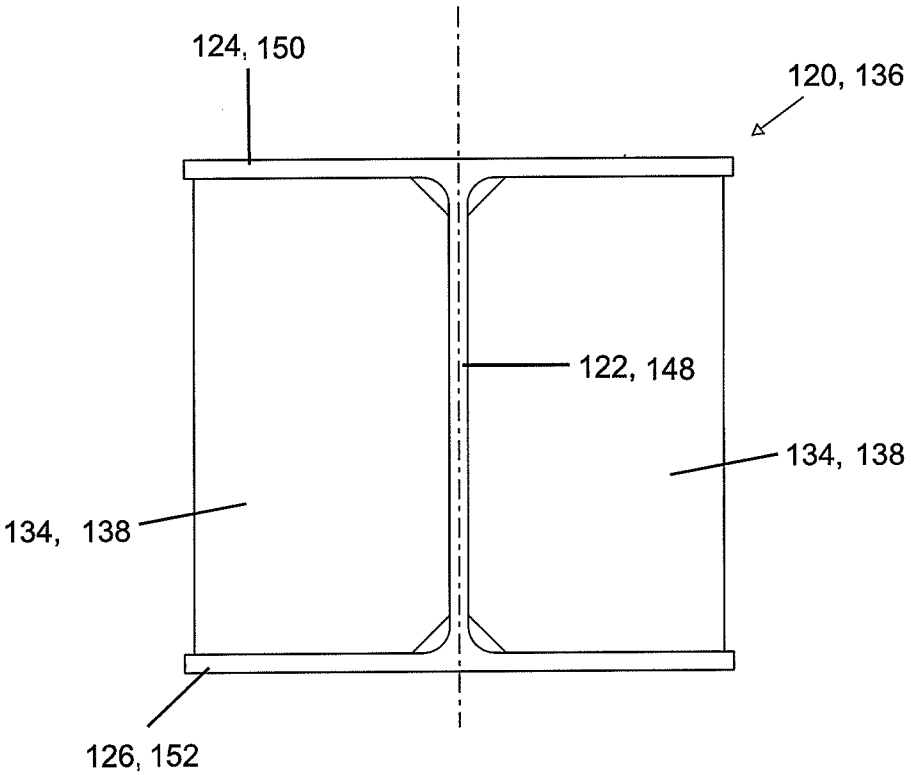
FIG. 5 is cross section view of an I-beam cap or of an I-beam sill used in constructing the first embodiment of the replacement bent in accordance with the present invention.

The cap beam 120 and the sill beam 136 are virtually identical in construction except for their length and positioning of hinges 128 and 142. The cross-section for both the cap beam 120 and the sill beam 136 is illustrated in FIG. 5. Both the cap beam 120 and the sill beam 136 have a top cap flange 124 and a top sill flange 150 respectively, a bottom cap flange 126 and a bottom sill flange 152 respectively, and a cap web 122 and a sill web 148 respectively. In addition, at the positions where the hinges 128 and hinges 142 connect the posts 154 to the cap beam 120 and to the sill beam 136, respectively, cap stiffener plates 134 and sill stiffener plates 138 are welded to the cap beam 120 and the sill beam 136 to provide added support at those points of connection (FIGS. 2, 3, and 5). Particularly, the cap stiffener plates 134 and the sill stiffener plates 138, which are ½ inch steel plates, are welded to the top flanges 124 and 150, to the bottom flanges 126 and 152, and to the webs 122 and 148 as shown in FIG. 5.

The replacement bent 112 described in connection with FIGS. 2-5 may be installed by the following method. Once a substandard bent, such as one of the bents 12 shown in FIG. 1, has been identified for replacement, the superstructure 22 of the bridge 10 is lifted by means of a crane, jacks, another shoring device, or other suitable means for temporarily lifting the superstructure 22 of the bridge 10 off of the substandard bent 12. The piles 14 are then cut off at ground level to create stub pilings 114 shown in FIG. 3. The replacement bent 112 is constructed by connecting the adjustable posts 154 to the sill beam 136 by means of the hinges 142. The other ends of the adjustable posts 154 are then connected to the cap beam 120 by means of the hinges 128. Based on the measurements taken between the top of the stub pilings 114 and the bottom of the bridge stringers 24, the adjustable posts 154 are telescoped so that the distance between the bottom of the bottom sill flange 152 and the top of the top cap flange 124 is equal to the distance between the top of the stub pilings 114 and the bottom of the bridge stringers 24. Once the adjustable posts 154 have been telescoped to provide the proper distance between the top of the stub pilings 114 in the bottom of the bridge stringers 24, the locking pins 164 are inserted into matching holes 162 to complete the construction of the replacement bent 112.

Once the replacement bent 112 has been constructed as described with the proper dimensions, the replacement bent 112 is positioned horizontally with the sill beam 136 positioned adjacent the top of the stub pilings 114. The replacement bent 112 is then rotated from the horizontal position to the vertical position by means of a crane with the sill beam 136 supported on the stub pilings 114. The sill beam 136 is then secured to the stub pilings 114 so that the sill beam 136 can not move in a horizontal direction. With the replacement bent 112 in the vertical position and with the cap beam 120 beneath the superstructure 22 of the bridge 10, the superstructure 22 of the bridge 10 is then lowered onto the cap beam 120 by the crane, jacks, another shoring device, or other suitable means and secured thereto.

Figure 6:
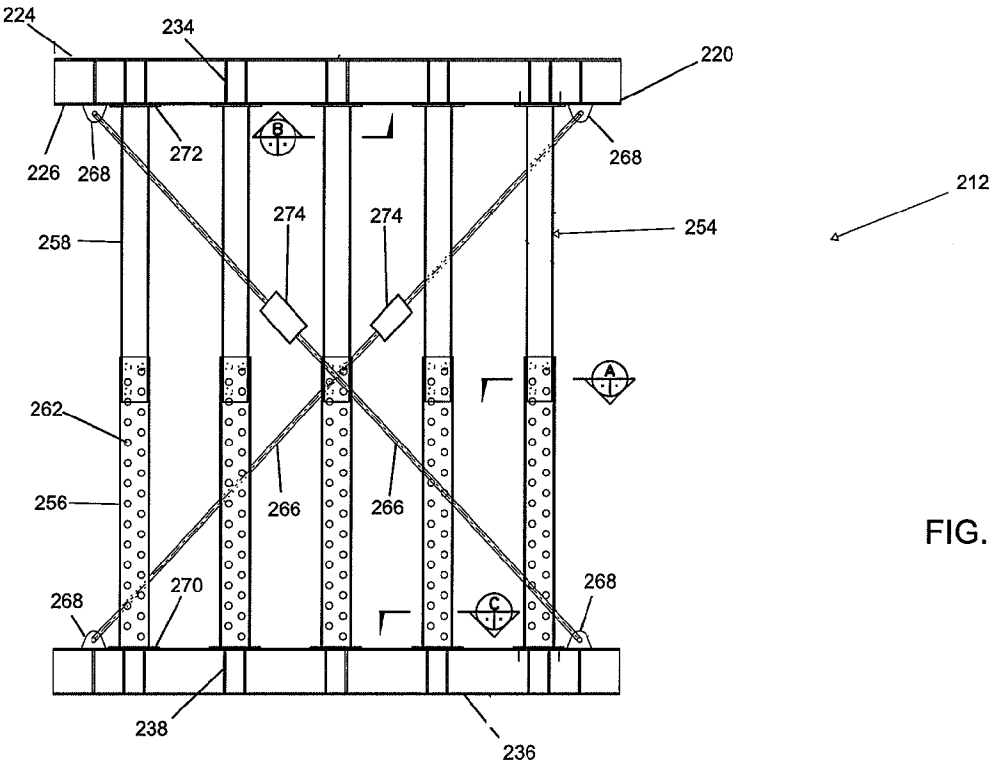
FIG. 6 is a front elevation view of a second embodiment of a replacement bent for shoring a bridge in accordance with the present invention.
Figure 7:
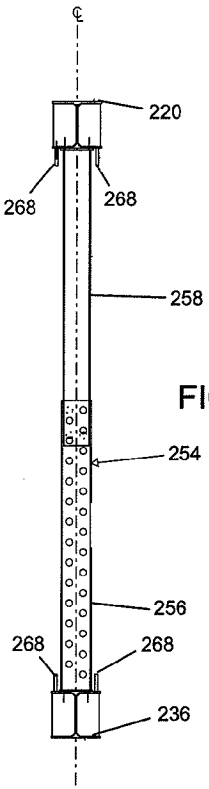
FIG. 7 is a side elevation view of the second embodiment of the replacement bent for shoring a bridge in accordance with the present invention.
Figure 10:
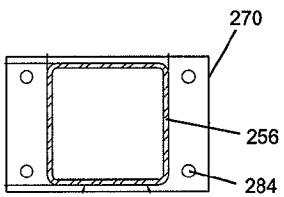
FIG. 10 is a section view of the adjustable post of the second embodiment of the replacement bent for shoring a bridge in accordance with the present invention as seen along line C-C of FIG. 6.
Figure 9:
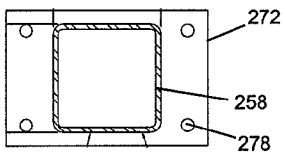
FIG. 9 is a section view of the adjustable post of the second embodiment of the replacement bent for shoring a bridge in accordance with the present invention as seen along line B-B of FIG. 6.
Figure 8:
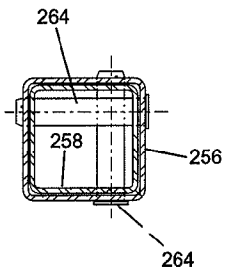
FIG. 8 is a section view of an adjustable post of the second embodiment of the replacement bent for shoring a bridge in accordance with the present invention as seen along line A-A of FIG. 6.

With reference to FIGS. 6-13, a second embodiment of the replacement bent 212 comprises a sill beam 236 comprising a metal I-beam, adjustable posts 254, a cap beam 220 comprising a metal I-beam, and cross braces 266 comprising for example steel cables, threaded rods, or steel shapes. The adjustable posts 254 are connected to the sill beam 236 by means of sill beam support plates 270 (FIGS. 6 and 10) and are connected to the metal cap beam 220 by means of cap beam support plates 272 (FIGS. 6 and 9).

In the embodiment shown in FIGS. 6-13, each of the adjustable posts 254 comprises a square internal tube 258 (FIG. 9) telescoped within a square external tube 256 (FIG. 10), While the adjustable posts 254 of the present invention are illustrated showing two sections 256 and 258, a greater number of sections may be employed to accommodate additional height. Further, the adjustable posts 254 may be constructed with other cross-sectional shapes including without limit round, oval, rectangular, triangular, hexagonal, etc. The internal tube 258 and external tube 256 both have a series of holes 262 spaced along their respective lengths. Locking pins 264 (FIG. 8) selectively engage the holes 262 in the internal tube 258 and external tube 256 to lock the internal tube 258 and the external tube 256 together at a predetermined length. By telescoping the internal tube 258 in and out of the external tube 256, the length of the post 254 can be varied to accommodate the height of the particular bridge 10 being shored.

In the second embodiment of the bent 212 shown in FIG. 6, the adjustable square posts 254 are positioned vertically and connected at right angles to the sill beam 236 by means of sill beam support plates 270 (FIGS. 6 and 10) and at right angles to the cap beam 220 by means of cap beam support plates 272 (FIGS. 6 and 9). In order to maintain the bent 212 square, cross braces 266, comprising for example steel cables, threaded rods, or steel shapes, are connected diagonally to gussets 268 positioned at the ends of the sill beam 236 and the cap beam 220. Each of the cross braces 266 includes at least one turnbuckle 274 so that the cross braces 266 can be adjusted to assure that the bent 212 is square and the cross braces 266 are sufficiently tight.

Figure 11:
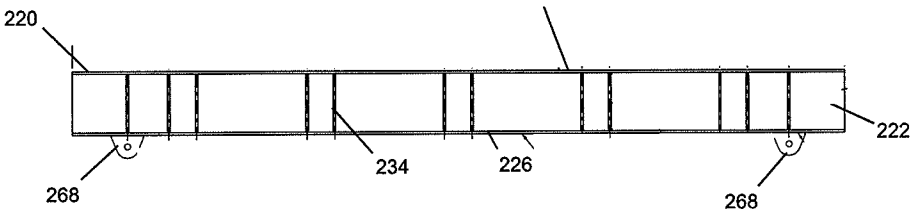
FIG. 11 is a front elevation view of a cap beam forming part of the second embodiment of the replacement bent for shoring a bridge in accordance with the present invention.
Figure 12:
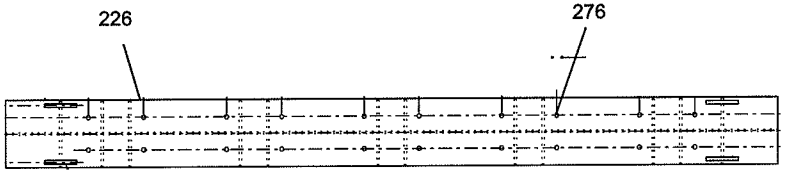
FIG. 12 is a bottom plan view of the cap beam forming part of the second embodiment of the replacement bent for shoring a bridge in accordance with the present invention.
Figure 13:
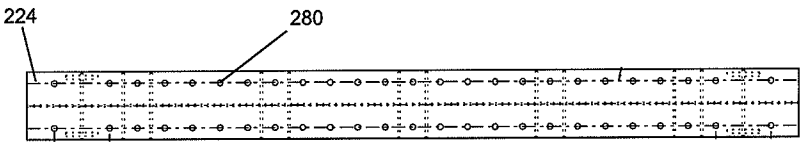
FIG. 13 is a top plan view of the cap beam forming part of the second embodiment of the replacement bent for shoring a bridge in accordance with the present invention.

FIGS. 11-13 illustrate the construction of the cap beam 220. The sill beam 236 is similarly constructed. The cap beam 220 is an I-beam comprising a web 222, a top cap flange 224 for engaging stringers 24 of the bridge 10 and a bottom cap flange 226 for engaging the support plates 272 of the internal tubes 258 of the adjustable posts 254. Cap beam stiffener plates 234 are welded to the cap beam 220 to provide added support at those points of connection between the cap beam 220 and the internal tubes 258 of the adjustable posts 254. Similarly, sill beam stiffener plates 238 (FIG. 6) are welded to the sill beam 236. Particularly, the cap stiffener plates 234 and the sill stiffener plates 238, which are ½ inch steel plates, are welded to the top flanges, to the bottom flanges, and to the webs of the sill beam 236 and the cap beam 220.

The bottom flange 226 of the cap beam 220 has a series of holes 276 (FIG. 12), which holes are spaced to match the holes 278 in the cap beam support plates 272 of the internal tubes 258 of the adjustable posts 254. Similarly, the top flange of the sill beam 236 has a series of holes (not shown) that are spaced to match the holes 284 in the sill beam support plates 270 of the external tubes 256 of the adjustable posts 254. The top flange 224 of the cap beam 220 also includes a series of holes 280 (FIG. 13). There are a large number of holes 280 in the top flange 224 in order to provide a variety of connection points for the stringers 24 that make up part of the superstructure 22 of the bridge 10. Similarly, the bottom flange of the sill beam 236 has a large number of holes (not shown) to provide a variety of connection points for the underlying cut off timber stub pilings 114 or a timber support mat 282 (FIGS. 15-17).

Figure 14:
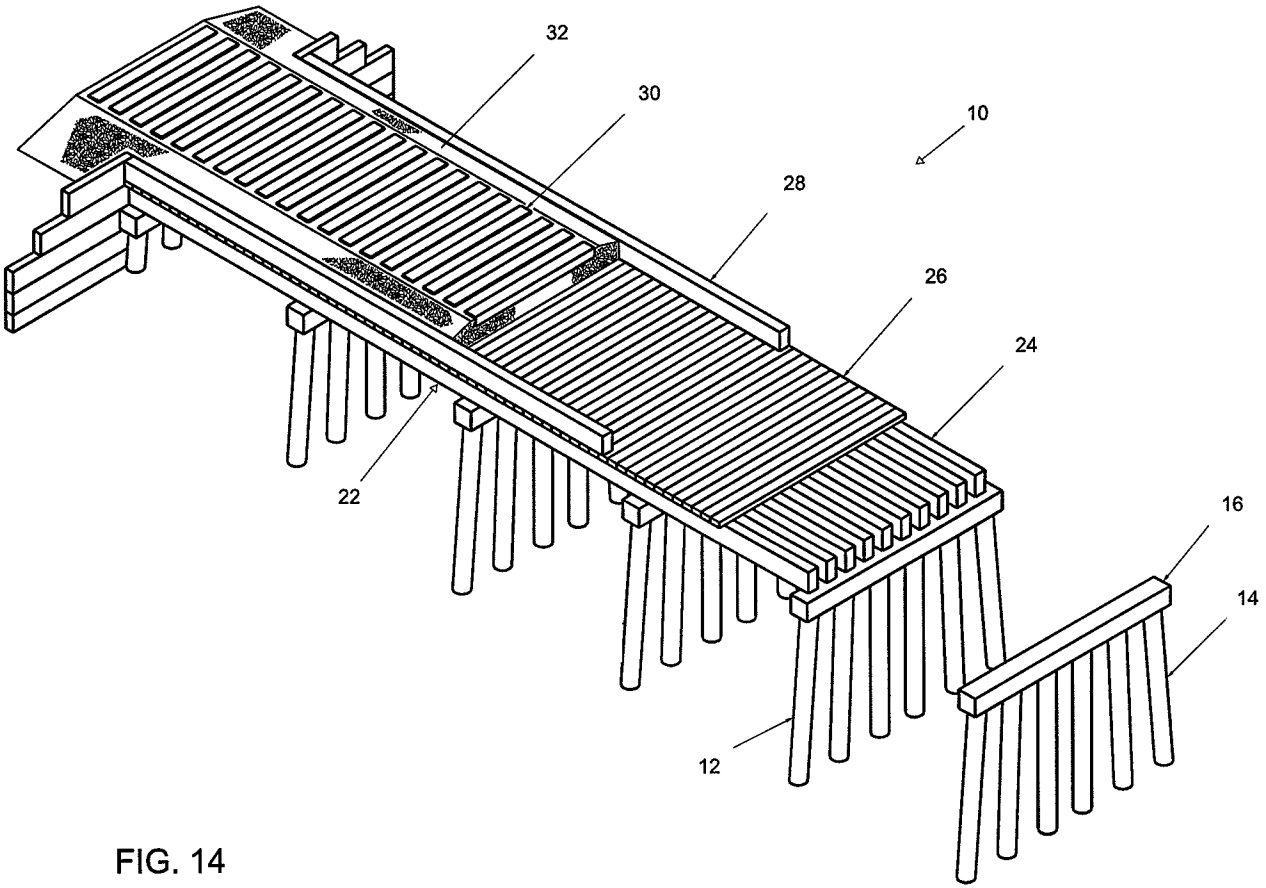
FIGS. 14-18 are prospective views of a bridge showing a sequence of steps employing the second embodiment of the replacement bent for shoring the bridge in accordance with a method of the present invention.
Figure 15:
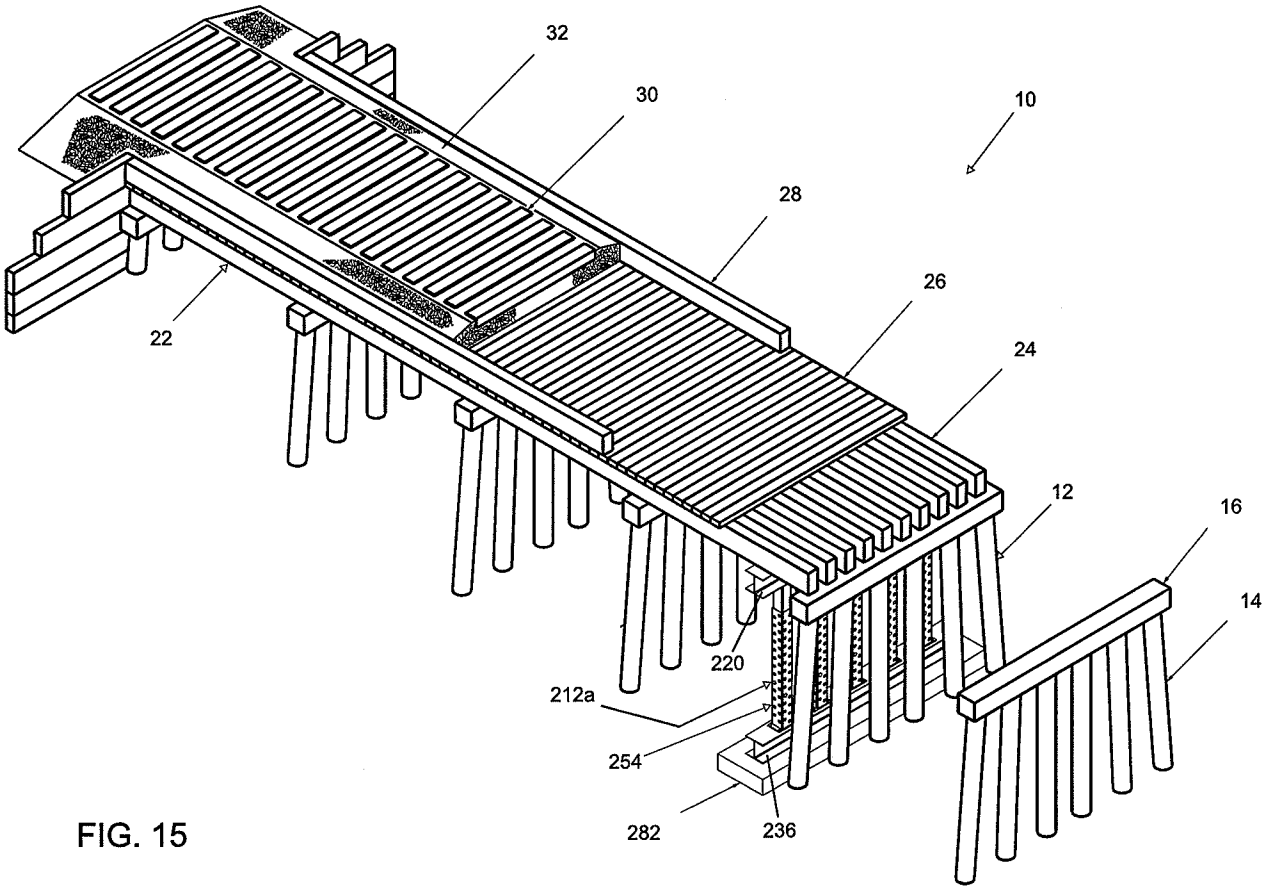

FIGS. 14-18 illustrate a method of using the replacement bent 212 to replace a defective timber bent, such as timber bent 12 shown in FIG. 14. The method begins with reference to FIG. 15. A first temporary replacement bent 212*a*, in accordance with the present invention and as described in connection with FIGS. 6-13, is positioned on the timber mat 282 beneath the superstructure 22 of the bridge 10. The cross braces 266, used in connection with replacement bent 212*a* are not shown in FIGS. 15-18 for the sake of clarity. The sill beam 236 of the temporary replacement bent 212*a* is supported by the timber mat 282, and the cap beam 220 is supported on the adjustable posts 254. Initially, the adjustable posts 254 are retracted so that the cap beam 220 does not engage the underside of the stringers 24. Hydraulic jacks (not shown) are positioned between the sill beam 236 and the cap beam 220. With the locking pins 264 removed from the adjustable posts 254, the hydraulic jacks are then activated to raise the cap beam 220 into engagement with the underside of the stringers 24 and to relieve the downward force by the superstructure 22 on the timber cap beam 16 of the timber bent 12. With the superstructure 22 thus elevated by means of the hydraulic jacks, the adjustable posts 254 of the replacement bent 212*a* are then locked in place by means of the locking pins 264, and the hydraulic jacks are removed. With the hydraulic jacks removed, the replacement bent 212*a* carries the load of the superstructure 22 of the bridge 10 to the left of the defective timber bent 12 as shown in FIG. 15.

Figure 16:
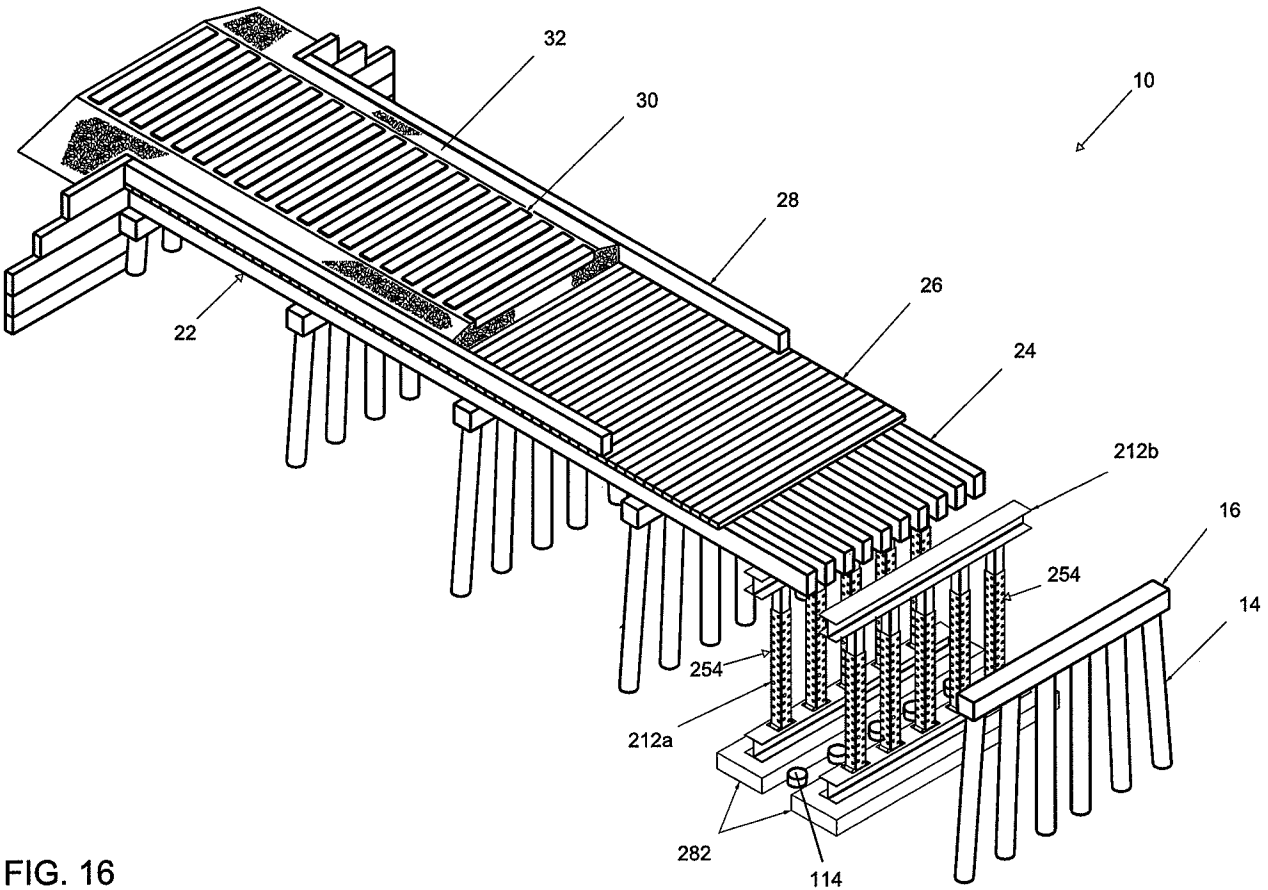

As shown in FIG. 16, a second temporary replacement bent 212*b* is installed in the same manner as previously described with respect to replacement bent 212*a* on the opposite (right) side of the defective timber bent 12 to support the superstructure (not shown for the sake of clarity) on the opposite side of the defective timber bent 12. Once the temporary replacement bents 212*a* and 212*b* are positioned as shown in FIG. 16 and are carrying the weight of the superstructure 22, the defective timber bent 12 is removed leaving only the cut off timber stub pilings 114.

Figure 17:
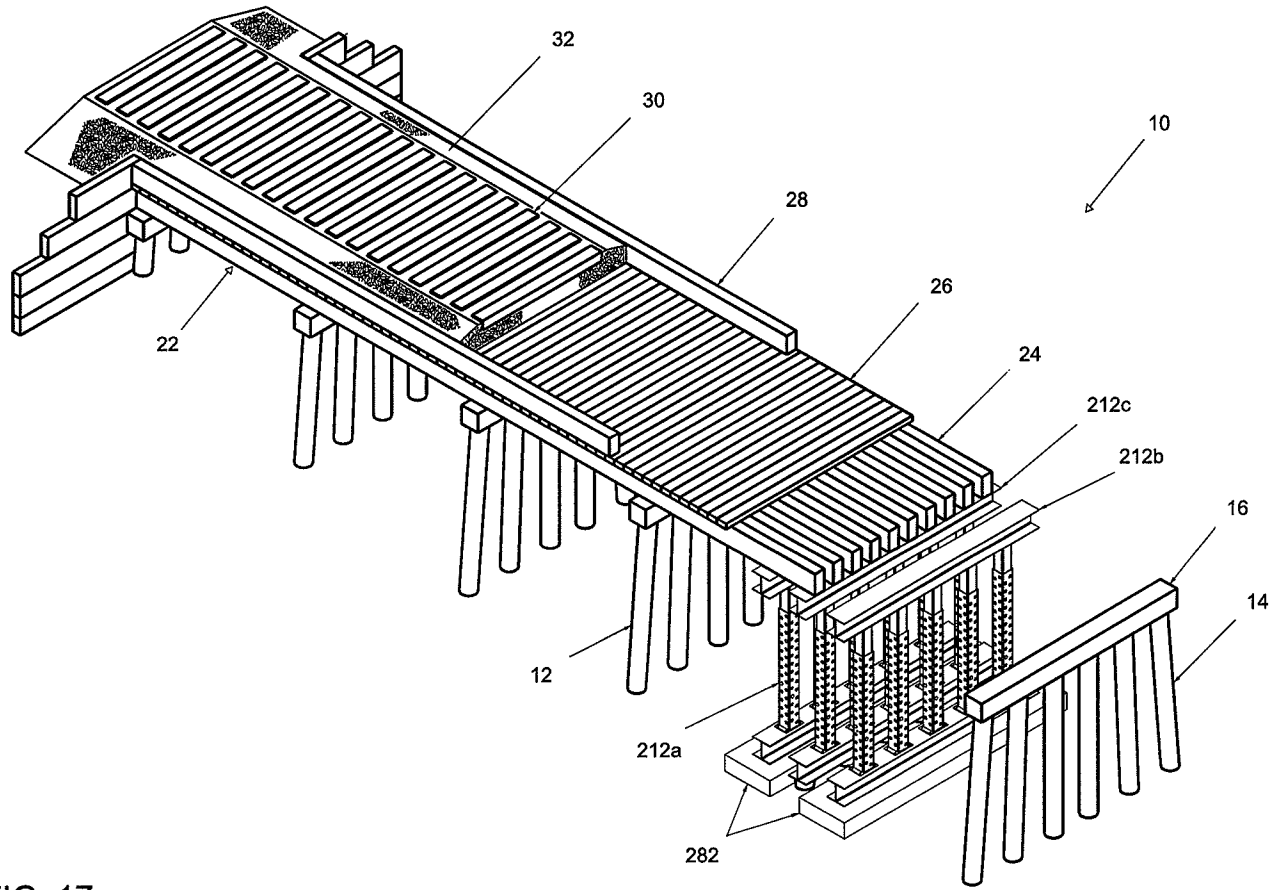
Figure 18:
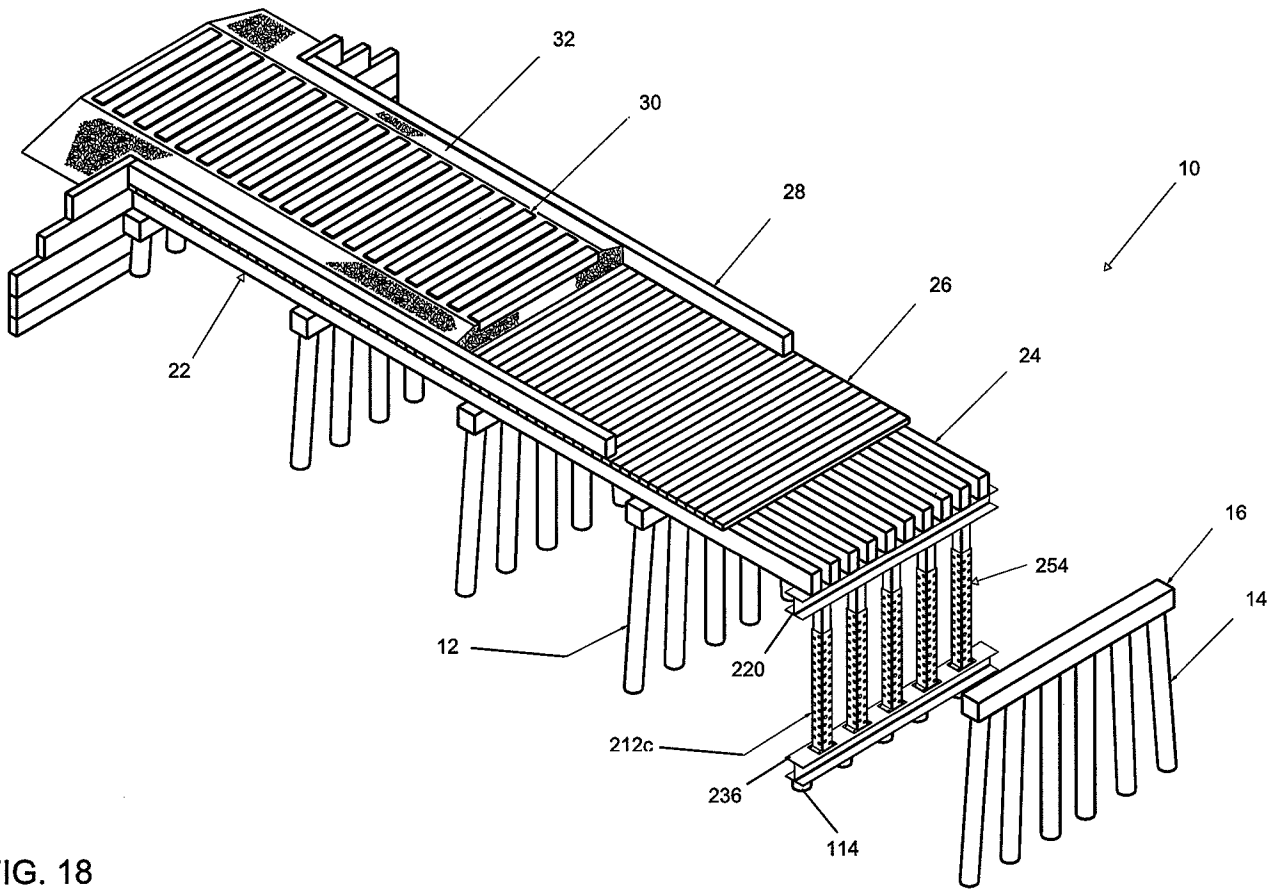

With reference to FIG. 17, a third replacement bent 212*c* is positioned between the temporary bents 212*a* and 212*b*. The sill beam 236 of the third replacement bent 212*c* is supported on the cut off timber stub pilings 114 and secured to the cut off timber stub pilings 114 by lag bolts through holes in the lower flange of the sill beam 236. With the locking pins 264 removed, the cap beam 220 is secured to the underside of the stringers 24 of the bridge 10 by means of lag bolts through the holes 280 in the upper flange of the cap beam 220. Once the third replacement bent 212*c* is in place and as shown in FIG. 17, the hydraulic jacks are then employed to raise the superstructure 22 of the bridge 10 so that the load is removed from the first and second replacement bents 212*a* and 212*b*, and then those bents can be removed. The hydraulic jack then lowers superstructure of the bridge 22 to a position where the locking pins 264 can be inserted in the adjustable posts 254 of the third replacement bent 212*c*. With the first and second replacement bents 212*a* and 212*b* removed and the locking pins 264 in place on the adjustable posts 254 of the third replacement bent 212*c*, the hydraulic jacks are then removed, and the superstructure 22 of the bridge 10 is supported by the third replacement bent 212*c*.

Accordingly, while the invention has been described with reference to the structures and processes disclosed, the invention is not confined to the details set forth, but is intended to cover such modifications or changes as may fall within the scope of the following claims.

We claim:

1. A method for shoring a bridge having a superstructure using a replacement bent to replace a substandard bent comprising the steps of:

a. raising the superstructure of the bridge to unload the superstructure of the bridge from the substandard bent;

b. removing the substandard bent and cutting pilings of the substandard bent to create a series of stub pilings;

c. positioning the replacement bent between the stub pilings and the superstructure of the bridge, the replacement bent comprising:

i. a metal sill beam configured to engage the series of stub pilings;

ii. a metal cap beam configured to engage the superstructure: and iii. a plurality of metal telescoping posts interconnecting the sill beam and the cap beam;

d. extending the telescoping posts of the replacement bent so that the sill beam is supported on the stub pilings and the cap beam engages the superstructure of the bridge;

e. locking the telescoping posts of the replacement bent; and f. lowering the superstructure of the bridge onto the cap beam of the replacement bent, wherein raising the superstructure of the bridge further comprises:

i. positioning a temporary bent between a support mat and the superstructure of the bridge, the temporary bent comprising:

a) a metal sill beam;

b) a metal cap beam: and c) a plurality of metal telescoping posts interconnecting the sill beam and the cap beam;

ii. extending the telescoping posts of the temporary bent by means of a hydraulic jack positioned between the cap beam and the sill beam so that the cap beam engages the superstructure of the bridge and thereby raises the superstructure of the bridge;

iii. locking the telescoping posts of the temporary bent with the superstructure of the bridge in its raised position; and iv. removing the hydraulic jack; and wherein locking the telescoping posts of the replacement bent comprises:

i. reinstalling the hydraulic jack between the cap beam and the sill beam of the replacement bent;

ii. raising the superstructure of the bridge to unload the superstructure of the bridge from the temporary bent by means of the hydraulic jack;

iii. unlocking the telescoping posts of the temporary bent and removing the temporary bent;

iv. lowering the superstructure of the bridge until the telescoping posts of the replacement bent are in a position to be locked; and v. locking the telescoping posts of the replacement bent.

2. The method of Claim 1, wherein the raising and lowering steps include temporary bents positioned on either side of the replacement bent.

* * * * *